United States Patent [19]

Smith

[11] Patent Number: 4,708,058

[45] Date of Patent: Nov. 24, 1987

[54] WATER PULSE SPRAY DAMPENING SYSTEM AND METHOD FOR PRINTING PRESSES

[75] Inventor: Gary R. Smith, Bucyrus, Kans.

[73] Assignee: Smith RPM Corporation, Overland Park, Kans.

[21] Appl. No.: 876,929

[22] Filed: Jun. 20, 1986

Related U.S. Application Data

[63] Continuation-in-part of Ser. No. 785,967, Oct. 10, 1985, abandoned.

[51] Int. Cl.[4] ..... B41F 7/30; B41F 7/26

[52] U.S. Cl. ..... 101/147; 101/451

[58] Field of Search ..... 101/147, 148, 350, 365, 101/366, 450.1, 451, 452, 132.5

[56] References Cited

U.S. PATENT DOCUMENTS

| | | | |
|---|---|---|---|
| 2,347,619 | 4/1942 | Taylor | 101/350 |
| 2,408,449 | 10/1946 | Russell et al. | 101/147 |
| 2,448,226 | 8/1948 | Marsden | 101/147 |
| 3,651,756 | 3/1972 | Smith, Jr. | 101/147 |
| 3,749,313 | 7/1973 | Weitmann | 239/127 |
| 3,835,774 | 9/1974 | Heidt | 101/148 |
| 3,939,668 | 4/1976 | Smith, Jr. | 101/148 |
| 4,064,801 | 12/1977 | Switall | 101/147 |
| 4,372,208 | 2/1983 | Legardinier | 101/366 |
| 4,469,024 | 9/1984 | Schwartz et al. | 101/147 |

FOREIGN PATENT DOCUMENTS

| | | | |
|---|---|---|---|
| 1611313 | 8/1971 | Fed. Rep. of Germany | 101/147 |

*Primary Examiner*—J. Reed Fisher

*Attorney, Agent, or Firm*—Schmidt, Johnson, Hovey & Williams

[57] ABSTRACT

An offset lithographic press, as commonly found in the newspaper industry, is provided with an airless, pulsed spray dampening system for simplified, automatic control of the ink/dampening fluid balance. The dampening system is constructed in accordance with several critical parameters, including the center-to-center nozzle spacings, nozzle to adjacent roller spacings, as well as the frequency of pulses per minute, the duration of each pulse, and the pressure of the dampening fluid. Construction of a dampening system in accordance with the critical parameters enables the press to be operated with a minimum of user intervention, and the relatively small spacing between the nozzles and the adjacent rollers is such that the dampening system can be mounted adjacent the aisles between the press units for facilitating maintenance thereon. The system directs a continuous, carefully controlled supply of dampening fluid to the plate so that the latter can be satisfactorily used with a minimum of fluid and does not experience moisture variations cycling between wet and dry conditions. A spray bar provided with eight nozzles oriented in parallel relationship to the longitudinal axis of an associated dampening system roller is detachably mounted to the frame and can be readily removed for repair or replacement.

21 Claims, 17 Drawing Figures

Fig.1.
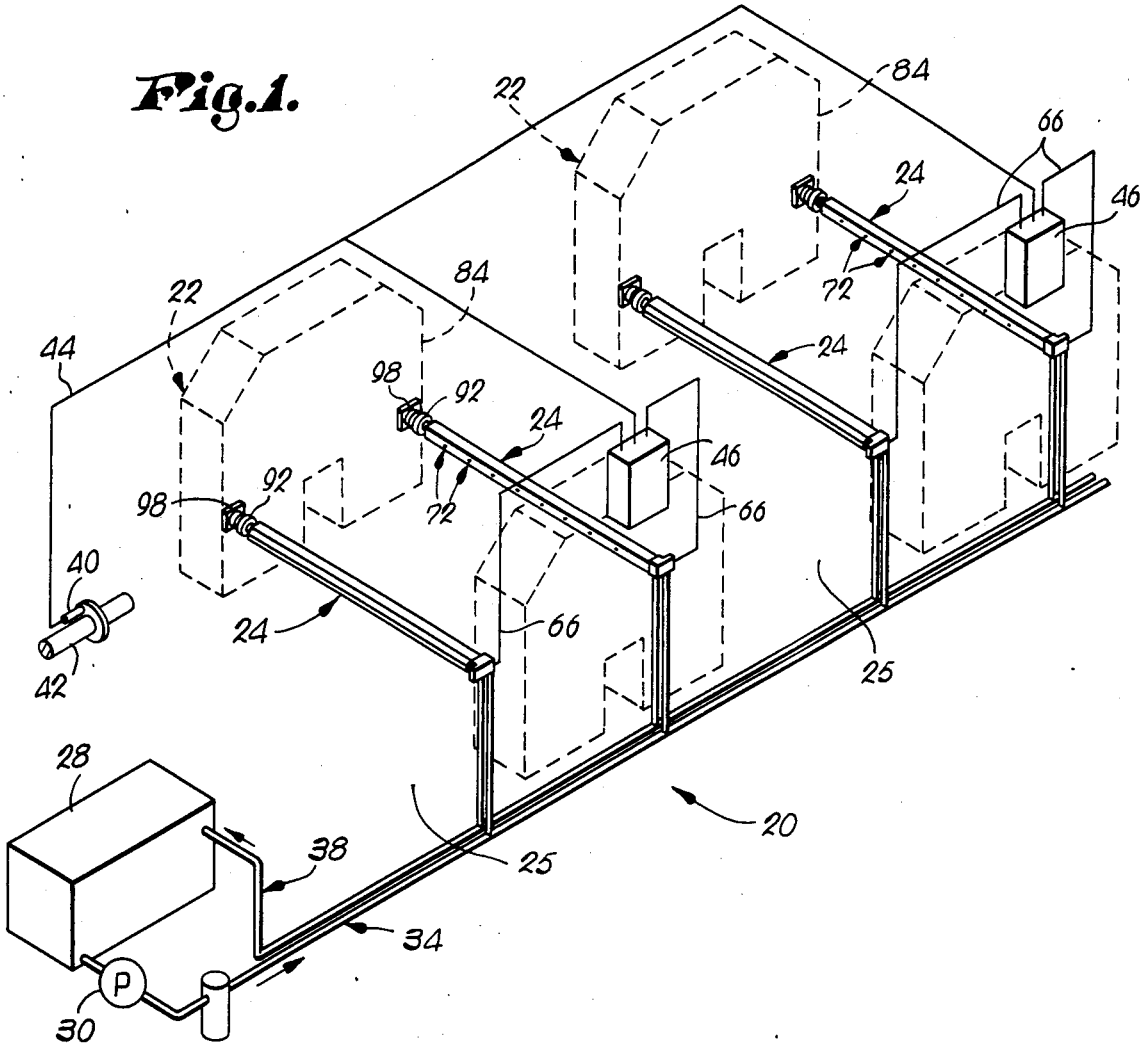
Fig.2.
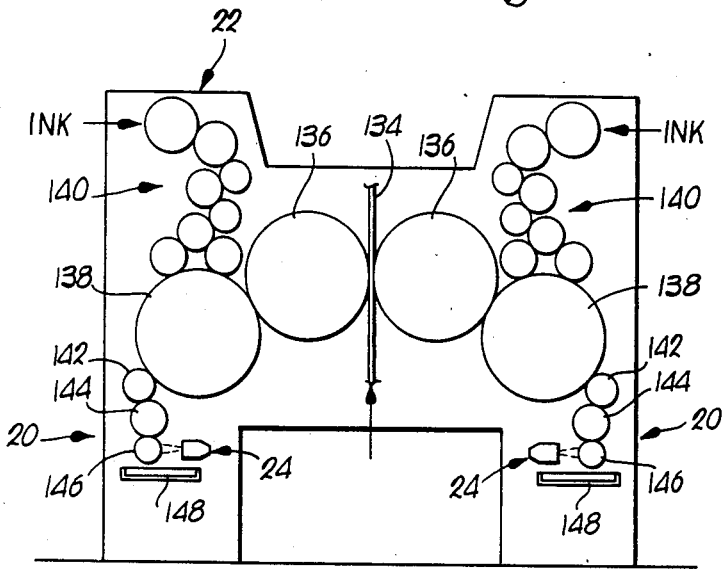
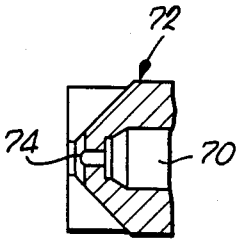
Fig. 16.
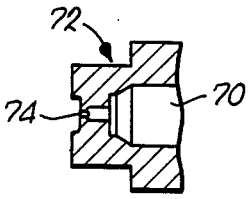
Fig.17.

WATER PULSE SPRAY DAMPENING SYSTEM AND METHOD FOR PRINTING PRESSES

RELATED APPLICATION

This application is a continuation-in-part of application Ser. No. 785,967 filed Oct. 10, 1985 entitled Water Pulse Spray Dampening System and Method for Printing Presses, and now abandoned.

BACKGROUND OF THE INVENTION

1. Field of the Invention

This invention relates to the discovery of certain critical operating parameters for an airless, pulsing spray dampening system suitable for use either on new offset lithographic presses or as a retrofit on older presses. Utilization of the parameters disclosed herein enables simplified yet accurate control of the ratio of ink to dampening fluid applied to the plate cylinder such that dampening fluid is evenly distributed over the entire area of the plate cylinder and the likelihood of excessive emulsification of the ink is substantially reduced.

2. Description of the Prior Art

The printing plate of an offset lithographic press typically has areas that have been previously etched for reception of an ink solution comprised of vehicles, pigments, dryers and other miscellaneous ingredients. The remaining, unetched portions of the plate comprise the non-image areas that are commonly supplied with dampening fluid or so-called "water" in order to resist the deposition of ink in these areas. As is known, high quality printing can be obtained only when the correct ink/dampening fluid balance is maintained. However, the ratio of ink to dampening fluid is a function of the type of plate, the number of image areas on the plate, the composition of the paper and also the chemistry of the dampening solution.

Failure to maintain the correct ink/dampening fluid balance can lead to disastrous results within a short period of time. Excessive emulsification of the ink occurs when an oversupply of water flows to the plate, and can dilute the strength of the ink and cause the printed image to lack sharp contrast. Additionally, excessive emulsification causes the ink to rub off the paper and onto the reader's hands. Oftentimes, it is necessary to stop the press once such excessive emulsification is observed, so that the ink train may be completely cleaned before a large quantity of printed copy is adversely affected.

Various means are available for dampening the lithographic plate. In some presses, a dampening roller rotates within an open trough containing a quantity of the dampening solution, and this roller in turn rotates against a series of transfer rollers associated with the plate cylinder to supply a film of fluid to the plate. Unfortunately, such systems are difficult to precisely control and the fluid is subject to evaporation and contamination.

In recent years, the use of spray dampening systems has become increasingly popular. Such spray dampening systems are disclosed, for example, in U.S. Pat. Nos. 3,651,756 to Smith, Jr., dated Mar. 28, 1972, as well as 4,064,801 to Switall, et al., dated Dec. 27, 1977. Both of these patents describe spray dampening systems wherein a valve means repetitively opens and closes to create a pulsed stream of water which is then directed through nozzles toward a dampening roller associated with the plate cylinder. The amount of water sprayed toward the dampening roller is automatically varied in accordance with the speed of the press.

Another type of dampening apparatus is illustrated in U.S. Pat. No. 4,469,024 dated Sept. 4, 1984 and concerns a pulsed spray dampener wherein an air pulse from a unit controller mechanically operates four air actuated valves which in turn interrupt a flow of dampening fluid through four nozzles respectively associated with the valves. However, the spray from the nozzles shown in U.S. Pat. No. 4,469,024 is directed toward a nip between an ink drum and an adjacent ink form in rolling contact with both the ink drum and an adjacent plate cylinder, which therey causes dampening fluid to become undesirably mixed with the ink and adversely change the quality of the printed image. Also, the response time normally associated with air actuated valves is relatively slow and somewhat imprecise and as a result the characteristics of the pulse of dampening fluid leaving the spray nozzle, such as the pulse duration, timing and frequency, cannot be precisely controlled within satisfactory tolerances.

When constructing a spray dampening system, it has been common practice to provide four nozzles spaced across the width of a press handling a double width newspaper such that each nozzle directs the spray toward a corresponding portion of the adjacent dampening roller. Typically, the double width of newspaper corresponding to four printed pages has a dimension ranging from 55" to 63", although in the United States, paper widths are commonly 55". As a result, each of the spray nozzles is positioned to provide coverage for approximately 27.5" to 31.5" of the adjacent dampening roller, and usually each nozzle is spaced 8" or more away from the roller so that the diverging spray has sufficient distance to spread. Unfortunately, existing presses often have insufficient clearance for mounting a retrofit spray system in the aisle between the presses at a location 8" from a dampening roller, and consequently such system must be installed within the arch of the press where acess is somewhat difficult.

Moreover, the pressure of the dampening solution applied to the nozzles of a spray system must be retained at relatively high levels in order to ensure that the spray is not only dispersed laterally across a sufficient width of the roller but also propelled with substantial forward velocity to ensure contact with the roller. Oftentimes, such pressures are maintained at 80 psi resulting in increased equipment as well as operating costs. The location of the nozzles at a distance of 8" or more spaced from an associated roller is also believed to impede any effort to effect an even dispersal of very small dampening fluid droplets, since the relatively large distance from the nozzle to the roller allows droplets to coalesce to form larger drops and consequently cause the spray to miss certain portions of the roller.

Additionally, spray dampeners often have nozzles that are coupled to a source of pressurized air and are arranged so that the pressure of the air assists in transporting the dispersed spray toward the roller. Unfortunately, it has been found that the air passageways often clog due to the large amount of airborne paper particulates and dust in the environment surrounding the press, even through the air itself may have been previously filtered. As can be appreciated, as soon as the nozzles are clogged, operation of the press must be interrupted to restore communication between the various passageways.

It is known that prior art spray dampeners cause the plate to experience moisture variations cycling between wet and dry conditions. Because ink has the ability to "hold" water, the user often increases the flow of dampening fluid to the plate in an attempt to create a water reservoir and avoid intermittent dryness. However, this practice results in such excessive plate moisture that the problems of unstable emulsification and ink rub-off soon become apparent.

In some instances, dampening systems have a roller in contact with the plate, and the roller is provided with an outer sleeve comprising a relatively soft cloth material. During operation of the press, dampening fluid soaks into the cloth and the sleeve is thereafter operable as a reservoir for the fluid, such as is particularly desirable where a ductor roller is used to intermittently supply dampening fluid from a water pan to the cloth covered roller. However, the use of a cloth sleeve prevents the nip between the cloth covered roller and the adjacent plate cylinder from uniformly smoothing the dampening fluid over the entire area of the roller as well as the outer surface of the plate cylinder. Unless the dampening fluid is evenly distributed to the plate, however, water spots will become apparent on the printed image, and such accumulations of water are generally difficult to quickly remove from the rollers of the press and, at the same time, a large quantity of paper from such press runs may have to be discarded because of the resulting poor quality image. Water spotting is particularly a problem at high press speeds and when relatively fine quality printing is sought. The paper sleeve is also known to cause slippage between the covered roller and any adjacent rollers and this slippage, as can be understood, further hinders the uniform distribution of dampening fluid across the rollers.

More importantly, it is desirable to provide a dampening control system that requires the least amount of operator attention and intervention. Unfortunately, prior art dampening systems with nozzles spaced 8" from the rollers and spraying approximately 120 pulses of dampening fluid per minute often cause an improper balance of the ratio between the dampening fluid and the ink, such that the operator must keep a watchful eye over the press at all times. Nonetheless, the ink/dampening fluid balance of such systems frequently becomes incorrect, whether or not due to the fault of the operator, and thereby the quality of the printed image is ruined.

It is oftentimes difficult to effect a uniform distribution of dampening fluid on a roller whenever a pressurized supply of dampening fluid is sprayed through a nozzle toward the roller. A continuous spray is somewhat undesirable because the small volume of dampening fluid that is required by the plate during each rotation of the plate cylinder cannot be uniformly distributed on a continuous basis. Also, it has been found that nozzles are typically spaced apart a distance from each other and are also spaced at distances from the associated roller such that an overlap of spray patterns on the roller resulting from adjacent nozzles causes an uneven distribution of dampening fluid along the length of the roller to a degree that cannot be corrected by subsequently metering the fluid through a nip between rollers.

Accordingly, it would be a desirable advance in the art if a simplified dampening system were constructed that would provide automatic control at all times for the amount of dampening fluid transferred to the plate regardless of press speed. Additionally, such a system would desirably be located adjacent the aisles between the press units so that maintenance of the system, when necessary, is facilitated. At the same time, such a system should operate satisfactorily without the use of pressurized air, so that costs of the system are maintained at relatively low levels.

SUMMARY OF THE INVENTION

The instant invention overcomes the disadvantages noted hereinabove by provision of a novel airless, pulsed spray dampener constructed in accordance within the ranges of certain critical parameters so that operation of the press is greatly simplified. The dampener includes nozzles which direct a pulsed spray of dampening fluid toward a rubber surfaced roller which is in rolling contact with a chrome, ebonite or nickel surfaced roller which in turn engages another rubber roller in surface contact with a plate cylinder, so that the flow of dampening fluid is metered between two nips presented by the three dampening system rollers, and subsequently is metered through a third nip while the fluid transfers from the third dampening system roller to the plate cylinder. The rubber rollers have a Shore A durometer hardness of 25 to 40, and the rubber surface is constructed to present a matted finish which enhances water dispersion over the entire surface of the rollers while reducing the tendency of the surface driven roller to slip.

The dampening system of the present invention continuously circulates the dampening fluid or "water" through conduits leading to the nozzles as well as through piping which returns a portion of the dampening fluid back to a reservoir for further filtering and subsequent recirculation. In this manner, a fresh supply of dampening fluid is constantly being circulated to the nozzles so that a portion of the fluid can be withdrawn for a pulse of spray while other fluid is quickly returned to the reservoir. All stagnant pockets or areas in the conduits and piping are eliminated in order to reduce the build-up of slime material, minerals or other contaminants.

All of the dampening system rollers are separate from and spaced from the ink drum and other components of the ink train in order to minimize mixing of the dampening fluid in the ink. Preferably, the third, rubber surfaced roller of the dampening system contacts the plate cylinder at a location ahead of the point of contact between inking rollers and the plate, so that the surface of the latter is moistened before receiving the ink.

The parameters which define the simplified spray dampening system of the instant invention include the frequency of pulses per minute, the time period or duration of each pulse, the pressure of the fluid at the nozzle, the distance of the nozzle from the adjacent dampening roller, as well as the distance between adjacent nozzles, so that the overlap of spray patterns on the associated dampening roller causes a substantially even distribution of fluid across the roller surface. In preferred embodiments, the nozzles are spaced 7.1 inches apart and 2.8 inches from the surface of the roller so that the overlap of spray patterns from adjacent nozzles is 1 inch and a pattern of overspray from nozzles located at each end of the spray bar terminates in an area of the roller a distance which corresponds to 1½ inches away from the edge of the plate mounted on the plate cylinder. Utilization of these critical nozzle spacings and spray pattern configurations enables the nozzles to be advantageously mounted on a spray bar adjacent the aisle between two press towers so that installation as well as any subsequent maintenance can be performed with ease, in contrast to conventional presses using nozzle characteristics and spray patterns which require the nozzles to be inconveniently mounted within the arch of the press.

Preferably, solenoid valves associated with each nozzle are cycled to create 350 pulses per minute at a full press speed of 40,000 papers per hour having a cutoff length of 22.75 inches, with the fluid pressure being maintained at a constant 40 psig. The duration of the pulse is equal to the time of opening of the valve during each energization of the solenoid coil, and such duration is preferably maintained at about 25 milliseconds. A tachometer sensor, such as a magnetic pick-up coupled to the drive shaft of the press, senses the revolutions per minute of the press and adjusts the frequency of the pulses in accordance with rpess speed.

Construction of a dampener in accordance with the principles of the instant invention thus enables a continuous, carefully controlled supply of dampening fluid to be directed toward the plate so that the latter does not experience moisture variations cycling between wet and dry conditions. By avoidance of such moisture variations, the press can be operated with less total water supplied to the plate whereby the quality of the printed image is enhanced and the problem of ink rub-off is virtually eliminated. Furthermore, construction and operation of a press in accordance with the parameters defined herein enables the dampening system to be generally fully automatic such that adjustment by the operator is rendered unnecessary.

BRIEF DESCRIPTION OF THE DRAWINGS

FIG. 1 is a fragmentary, perspective, partially schematic view of the spray pulse dampening system of the present invention wherein spray bars are detachably mounted adjacent the aisles between side-by-side press towers or units;

FIG. 2 is a side sectional view in partially schematic form showing the spray system of Fig. 1 installed as a retrofit dampener for a single press unit having dual plate cylinders;

FIG. 16 is an enlarged, fragmentary, cross-sectional view taken along a horizontal plane of the tip of the nozzle shown in FIG. 14; and FIG. 17 is an enlarged, fragmentary, end sectional view of the nozzle tip shown in FIG. 16.

DETAILED DESCRIPTION OF THE DRAWINGS

Figure 3:
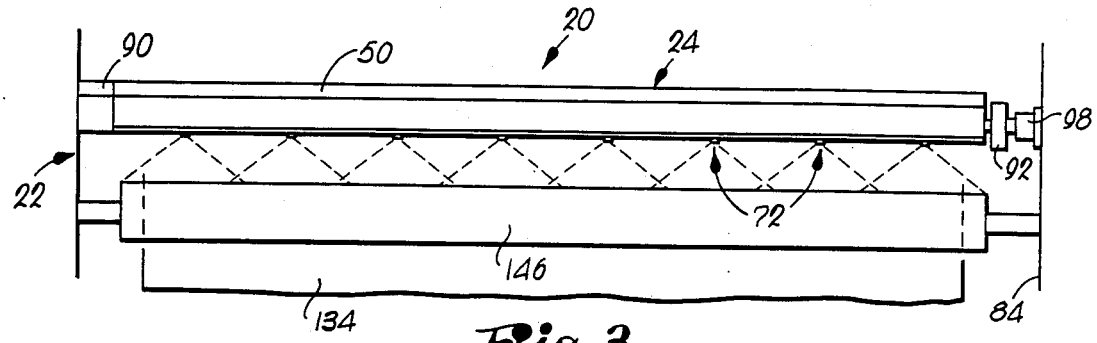
FIG. 3 is a fragmentary plan view illustrating the representative width of coverage of the spray nozzles shown in FIG. 2 in relation to a four page, double width newspaper.

Referring initially to FIG. 1, a spray dampening system constructed in accorance with the principles of the present invention is designated broadly by the numeral 20 and is shown, as an example, as mounted on a pair of side-by-side, double width press units 22, 22 the latter of which are represented by dashed lines depicting respective end arched structures. A spray bar 24 is secured to each side of the units 22, 22 adjacent the aisles 25 between each pair of units 22, 22 and each of the bars 24 has eight spaced nozzle assemblies 26 for spraying dampening fluid or "water" toward an adjacent, associated dampening roller (not shown in FIG. 1).

A dampening fluid supply cabinet 28, in cooperation with a constant volume diaphragm pump 30, comprises a supply of pressurized dampening fluid. A conduit means or dampening fluid supply line 34 is coupled with the cabinet 28 and the pump 30 for communicating the fluid to each of the spray bars 24. A filter 36 disposed downstream of the pump 30 removes contaminates in the fluid to prevent clogging of the nozzle assemblies 26 and the buildup of slime, problems particularly otherwise noticed when tap water comprises a substantial portion of the dampening fluid. Additionally, a dampening fluid return line 38 coupled to each of the spray bars 24 enbales return of dampening fluid to the supply cabinet 28.

In practice, it has been found that a Model No. 1AOD-A diaphragm pump manufactured by Marlow Pumps ITT of Midland Park, N.J. is especially suitable for use as the pump 30 of the present invention. The Marlow pump has an air-actuated diaphragm that is balanced by pressurized air on one side and pressurized dampening fluid on the other side in order to extend the life of the diaphragm in comparison to mechanically actuated diaphragm pumps. Furthermore, the diaphragm pump 30 represents simplified practice in contrast to prior art dampener pumping systems comprising a pair of tanks pressurized by regulated, compressed air and having valving for discharge of dampening fluid repetitiously between alternative tanks.

A tachometer sensor 40, such as a magnetically induced pick-up device, detects the speed of rotation of a drive shaft 42 powering the press units 22, 22. A wire lead 44 coupled to the sensor 40 is connected to a dampener control station 46 mounted on each of the units 22.

Figure 14:
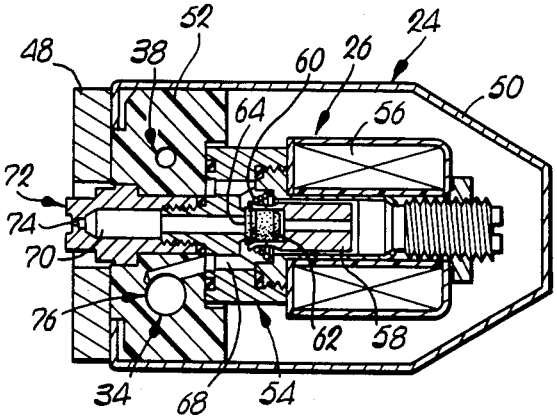
FIG. 14 is an enlarged, end cross-sectional view of the spray bar with the nozzle end coil assembly that is positioned at the righthand side of the spray bar.
Figure 8:
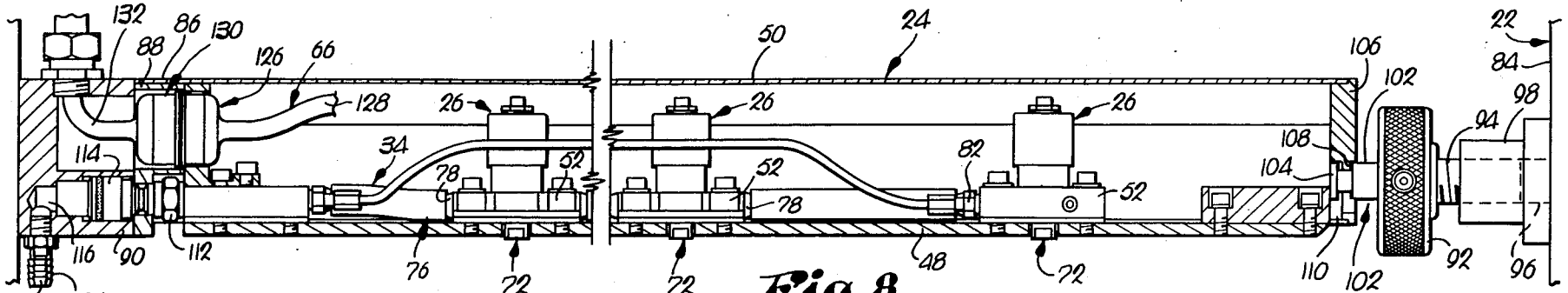
FIG. 8 is a fragmentary, enlarged, horizontal sectional view of one of the detachable spray bars illustrated in FIG. 1.
Figure 9:
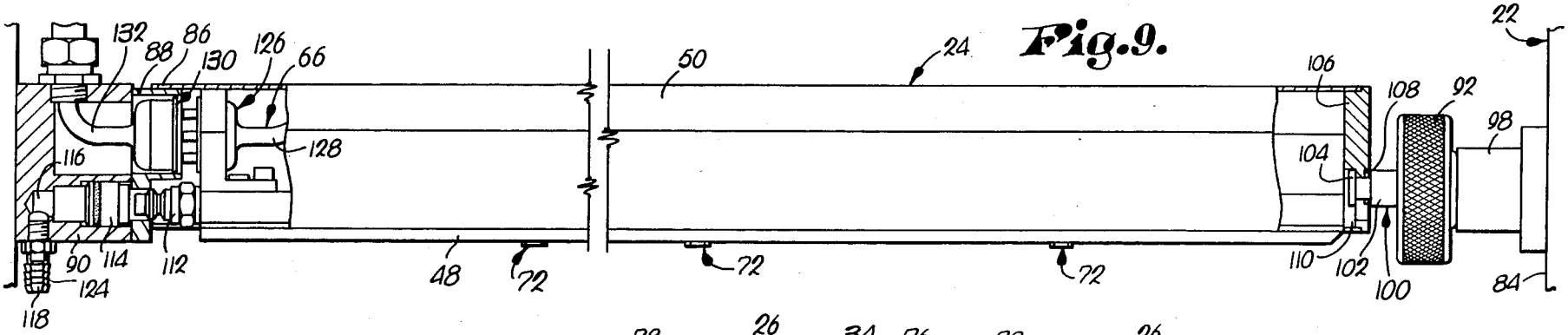
FIG. 9 is a view similar to FIG. 8 wherein a knob or member is rotated to shift the spray bar and disconnect couplings which otherwise join fluid conduits leading to the nozzles and also separate electrical contacts for a wire lead electrically connected to solenoid coils associated with each valve.

Viewing FIGS. 8, 9 and 14, each of the spray bars 24 includes an elongated, rectangular plate or support 48 connected on one side thereof to a housing 50. The spray bar 24 also includes eight elongated blocks 52 (FIGS. 8 and 14) secured to the plate 48, and each of the assemblies 26 is mounted on one of the blocks 52 and is substantially enclosed by the housing 50.

Each of the assemblies 26 includes a valve means 54 that is coupled to the supply line 34 for interruption of the flow of dampening fluid through the latter. As shown in FIG. 14, the valve means 54 includes an electrically actuated solenoid coil 56 and an internal, reciprocable plunger 58 that is normally biased by a spring 60 toward a position wherein a rubber disk 62 coupled to one end of the plunger 58 is in sealing engagement with a circular valve seat 64. A wire lead 66 (see FIG. 1) is coupled to the solenoid coils 56 as well as the control station 46 for selective operation of the valve 54. The lead 66 includes a number of separate wires so that each of the eight solenoid coils 56 in each spray bar 24 can be independently controlled by a separate, infinitely variable potentiometer (not shown) that is mounted to the control station 46 for manual control during operation of the press unit 22.

As illustrated in FIG. 9, the block 52 has an internal passageway comprising a portion of the supply line 34, and each of the assemblies 26 has a chamber 68 that communicates with the supply line 34. Energization of the coil 56 retracts the plunger 58 against the bias presented by the spring 60 such that the disk 62 is spaced from the valve seat 64, whereupon the flow of pressurized dampening fluid is directed through a channel 70 disposed within a nozzle 72.

Referring now to FIGS. 16–17, the tip of each nozzle 72 has generally conical walls defining the outwardmost end of the channel 70 and an elongated slot or orifice 74 communicates the channel 70 to areas external of the nozzle 72. The conically configured walls enable the slot 74 to be enlarged by a suitable cutting operation so that the desired flow rate can be attained. In practice, it has been found that a nozzle as manufactured by Spray Systems Company of Wheaton, Ill. and sold under the tradename Unijet® (tip number 11001), with the opening of 0.026", is especially suitable for practice of the instant invention.

Figure 13:
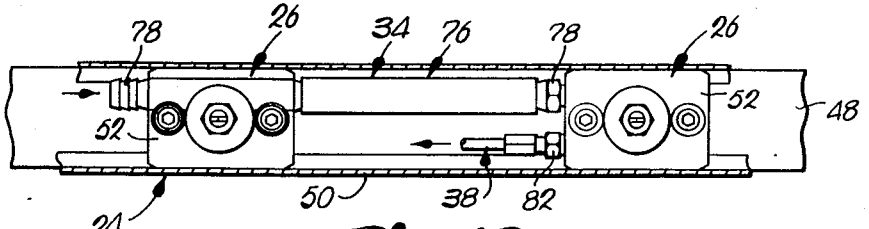
FIG. 13 is a fragmentary, enlarged, side sectional view of the spray bar shown in FIGS. 8 and 9 and illustrating two of the nozzles and the conduits associated with the nozzles.

Viewing FIGS. 8, 13 and 14, each of the adjacent nozzle assemblies 26 is connected to a first piping means 76 comprising a part of the conduit means or supply line 34 and interconnected by fittings 78 to the blocks 52. Additionally, a second piping means or return line 38 of conduit means 34 is positioned within the housing 50 so that unused fluid conveyed by the supply line 34 toward the end of the spray bar 24 may be directed back toward the supply cabinet for subsequent recirculation. The return line 38 has a ⅛ inch outer diameter and thereby is of a dimension to provide resistance to the flow of dampening fluid back to the supply cabinet 28.

Figure 15:
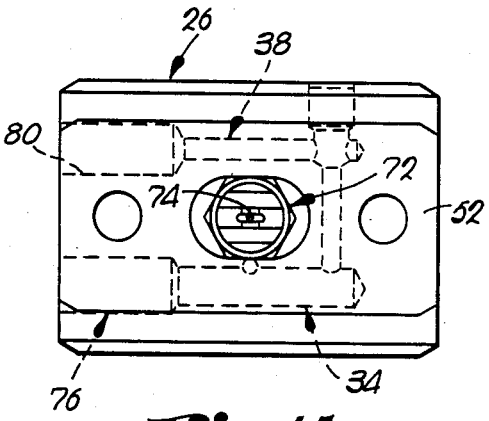
FIG. 15 is an enlarged, side view of the end nozzle and coil assembly shown in FIG. 8.

As illustrated in FIGS. 13–15, the nozzle assembly 26 that is located on the extreme righthand end portion of the spray bar 24 (see FIG. 8) has a slightly different configuration than the remaining nozzle assemblies 26, and in FIG. 15 the first piping means 76 of the conduit means 34 is directly coupled to the second piping means or return line 38 of the conduit 34, and an enlarged bore 80 (FIG. 15) receiving a fitting 82 (FIGS. 8 and 13) adapted to receive the ⅛ inch O.D. tubing which comprises the remaining portion of the return line 38.

As depicted in FIGS. 8 and 9, the spray bar 24 is detachably mounted on a frame 84 of the press unit 22 by means of an outwardly extending, inverted generally U-shaped flange portion 86 of the housing 50 which is slidably engageable with a shoulder 88 of a base 90 that is fixed to the frame 84. Comparing FIGS. 11 and 12, the flange portion 86 which extends from a first end portion of the spray bar 24 (which represents the left-hand side of the spray bar 24 shown in FIGS. 8 and 9), is formed to complementally engage five surfaces on the shoulder 88 of base 90 for purposes to be explained hereinafter.

The mounting means, which includes the flange portion 86 and a shoulder 88, also includes a knob or member 92 which detachably interconnects a second end portion of the support 48 and the press frame 84, wherein the second end portion is remote from the first end portion and is depicted on the righthand side of the spray bar 24 shown in FIGS. 8 and 9. The member 92 is fixedly coupled to a threaded shank 94 received in a complemental bore 96 of an object 98 that is secured to an opposite side of the press frame 84 remote from the base 90. The member 92 is also fixed to a shaft 100 which has a cylindrical portion 102 as well as a cylindrical head 104.

Figure 10:
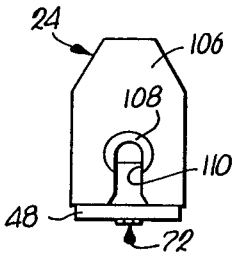
FIG. 10 is an enlarged, end elevational view of the righthand side of the spray bar shown in FIG. 9.

The second end portion or the righthand side of the spray bar 24 as illustrated in FIGS. 8 and 9 has a plate 106 (see also FIG. 10) which is formed with a cylindrical counterbore 108 as well as a slot 110 that is generally smaller in width than the diameter of the counterbore 108.

Rotation of the member 92 in one direction causes the shank 94 to move away from the object 98 to enable the outer shoulder of the cylindrical portion 102 of shaft 100 to become seated in the counterbore 108 (FIG. 8), whereupon further rotation of the member 92 shifts the spray bar 24 toward the base 90. Rotation of the member 92 in the opposite direction shifts the cylindrical portion 102 away from the counterbore 108, as illustrated in FIG. 9, and also causes the head 104 of shaft 100 to become engaged with a portion of the plate 106 opposite the counterbore 108, and subsequently continued rotation of the member 92 in the same direction moves the spray bar 24 away from the base 90.

Figure 11:
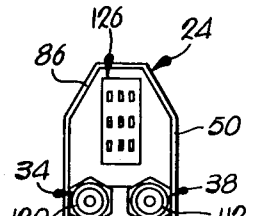
FIG. 11 is an enlarged, end elevational view of the lefthand side of the spray bar shown in FIG. 9.
Figure 12:
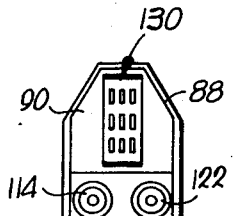
FIG. 12 is an end elevational view of the set of electrical contacts and fluid conduit couplings shown on the lefthand side of FIG. 9 and which are mounted on a frame of the press.

Referring to FIGS. 8, 9 and 11, the return line 38 includes a first coupling body comprising a fitting 112 that is mounted on the first end portion of the spray bar 24. The fitting 112 is engageable with a second coupling body that is secured to the press frame 84 and which includes a shiftable valve device 114 that is received within a bore 116 of base 90. Fitting 118 communicates bore 116 to remaining portions of the return line 38 to enable dampening fluid to flow to the supply cabinet 28.

In similar fashion, the supply line 34 includes a first coupling body comprising a fitting 120 (FIG. 11) mounted on the first end portion of the spray bar 24. The fitting 120 is engageable with a second coupling body comprising a valve device 122 (FIG. 12) that is received within a bore of base 90 and which communicates with a fitting 124 for receiving fluid from the filter 36.

The first end portion of the spray bar 24 also carries a male first set of contact elements 126 that is electrically connected to a first lead means 128 which is positioned within the housing 50 and which forms a part of the lead 66. The base 90 supports a female second set of contact elements 130 which are electrically coupled to a second lead means 132 also forming a portion of the lead 66. The first lead means 128 and the second lead means 132 include a number of wires so that the control station 46 can independently actuate each of the solenoid coils 56 as may be desired.

In normal use of the dampening system 20, the spray bar 24 is positioned as shown in FIG. 8 such that the male contact elements 126 are mechanically and electrically received within the female contact elements 130. At the same time, the fittings 112, 120 engage the shiftable valve devices 114, 122 respectively to open both of the latter and enable the flow of dampening fluid from the supply cabinet 28 to each of the nozzle assemblies 26, as well as to enable the return of dampening fluid through line 38 and back to the supply cabinet 28. However, when it is desired to remove the spray bar 24 from the press 22, member 92 is rotated to engage head 104 against plate 106 and thereafter shift the spray bar support 48 in a longitudinal direction toward the righthand side of FIG. 9. Simultaneously, and as shown in FIG. 9, shifting of the spray bar support 48 to the right will disengage the male contact elements 126 from the female contact elements 130 to electrically interrupt the flow of current to each of the solenoid coils 56. At the same time, fittings 112, 120 will move away from the valve devices 114, 122, causing both of the latter to shift to the right as illustrated in FIG. 9 by an internal spring to a closed position, which immediately seals the portion of the supply line 34 and the return line 38 that are fixed to the press frame 84 and prevent escape of dampening fluid through fittings 118, 124 on the base 90.

Removal of the spray bar 24 from the press unit 22 is accomplished by lifting the righthand side or second end portion of the spray bar support 48 in an upwardly direction when the spray bar 24 is in the position shown in FIG. 9. The bar 24 during removal pivots about the outermost and top edge of the flange portion 86, and the cylindrical head 104 simultaneously moves along slot 110 until plate 106 clears shaft 100. At this time, the spray bar 24 can be shifted upwardly and to the right viewing FIG. 9 until the entire flange portion 86 clears shoulder 88 of base 90, to allow the bar 24 to be completely removed from press unit 22. Installation of another bar 24 may thereupon be accomplished by reversal of these steps.

As can be appreciated, the flange portion 86 in cooperation with shoulder 88 maintains the orientation of the spray bar 24 in a predetermined position relative to the orientation of base 90, so that during installation of the bar 24 the fittings 112, 120 as well as the male contact elements 126 can be readily and accurately received by valve devices 114, 122 and the female contact elements 130 correspondingly. Moreover, removal and installation of the spray bar 24 can be accomplished during operation of the press unit 22, since the shiftable valve devices 114, 122 immediately shut off that portion of the flow of dampening fluid which would normally be directed to the same spray bar, so that leakage of the fluid is substantially precluded. As a result, it is therefore possible to maintain a number of idle spray bars 24 on hand at any one time, so that any of the bars 24 in use can be quickly replaced if problems associated with spraying of the dampening fluid are detected.

Turning now to FIG. 2, the dampening system 20 of the present invention is shown for exemplary purposes as might be installed as a system for a new press, or as a retrofit unit for the press having an existing water train. In such a press, a continuous web of newspaper 134 is directed upwardly toward the nip between an adjacent pair of side-by-side blanket of rollers 136, 136 which are each in rolling surface contact with a respective plate cylinder 138, 138. A conventional lithographic plate is mounted on the surface of each of the plate cylinders 138 and has at least one ink receptive area corresponding to image areas of the printed image, as well as other areas that are not receptive to ink.

Each of two ink trains, broadly designated 140, has a series of rollers for transferring a film of ink to one of the plate cylinders 138. Spaced from the ink train 140 on each side of the press 22 is the dampening system 20, which includes a first roller 142, a second roller 144 (that is optionally longitudinally oscillable) and a third roller 146. The longitudinal axis of the spray bar 24 is parallel and substantially horizontally aligned with the longitudinal axis of the third roller 146, so that the nozzles 72 provide an elongated, overlapping pattern of spray along the length of the third roller 146, as shown in FIG. 3. Also, the longitudinal axes of rollers 142, 144 and 146 are parallel with the rotational axis of plate cylinder 138. A water pan 148 (FIG. 2) piped to a drain system catches any accidental leakage or drippage which might occur, for example, during startup of the dampening system 20.

The first roller 142 is in rolling surface engagement with the plate cylinder 138 and has a flexible, synthetic rubber surface having a depth of ½ inch with a Shore A durometer hardness of 25 to 40. The second roller 144 is in rolling contact with the first roller 142 and has a hydrophilic outer surface which is selected from the group consisting of chromium, nickel and ebonite, and the surface of roller 144 has a Shore A durometer hardness of 99. The third roller 146, in turn, is in rolling engagement with the second roller 144 and has a flexible, synthetic rubber surface with a depth of ½ inch and with a Shore A durometer hardness of 25 to 40, similar to the first roller 142.

Both of the rubber rollers 142, 146 are provided with a matted surface finish, which facilitates dispersion of the dampening fluid throughout the entire surface area of the rollers 142, 146 and which also tends to reduce slippage between the rollers since the latter are surface driven from the plate cylinder 138. In practice, it has been found that a 120 grit, sandpaper type material comprised of silicon carbide particles provides a superior finish when the sandpaper material is applied at 70 to 80 pounds of pressure against the rollers 142, 146 while the latter are rotated at approximately 1,200 rpm. The sandpaper is applied against the surface of the rollers 142, 146 in a dry fashion until the surface of the same has a uniform, matt finish, and subsequently the surface of the rollers 142, 146 is lightly buffed. It has been found that use of the 120 grit silicon carbide sandpaper provides a superior surface finish for the purposes of the dampening system disclosed herein in comparison to a finish which is sometimes provided by applying a 180 grit sandpaper material against a rubber surfaced roller.

Figure 7:
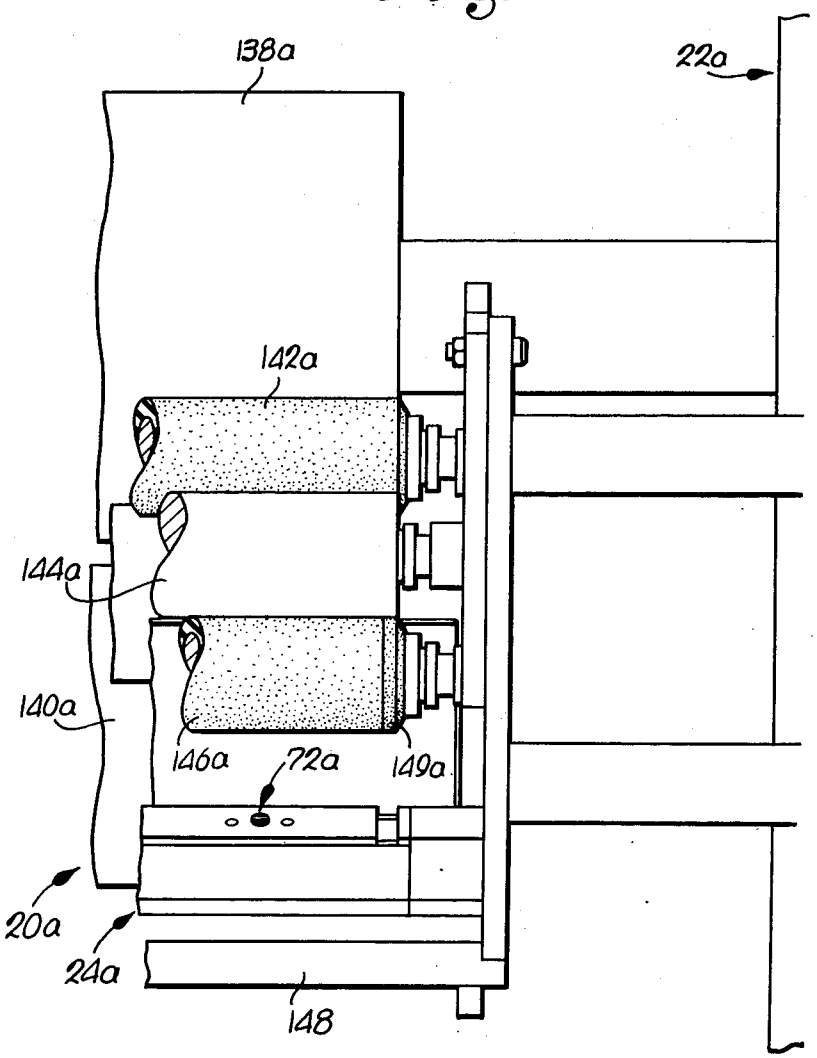
FIG. 7 is a fragmentary, enlarged, end elevational view of the press and dampening system shown in FIG. 6.
Figure 6:
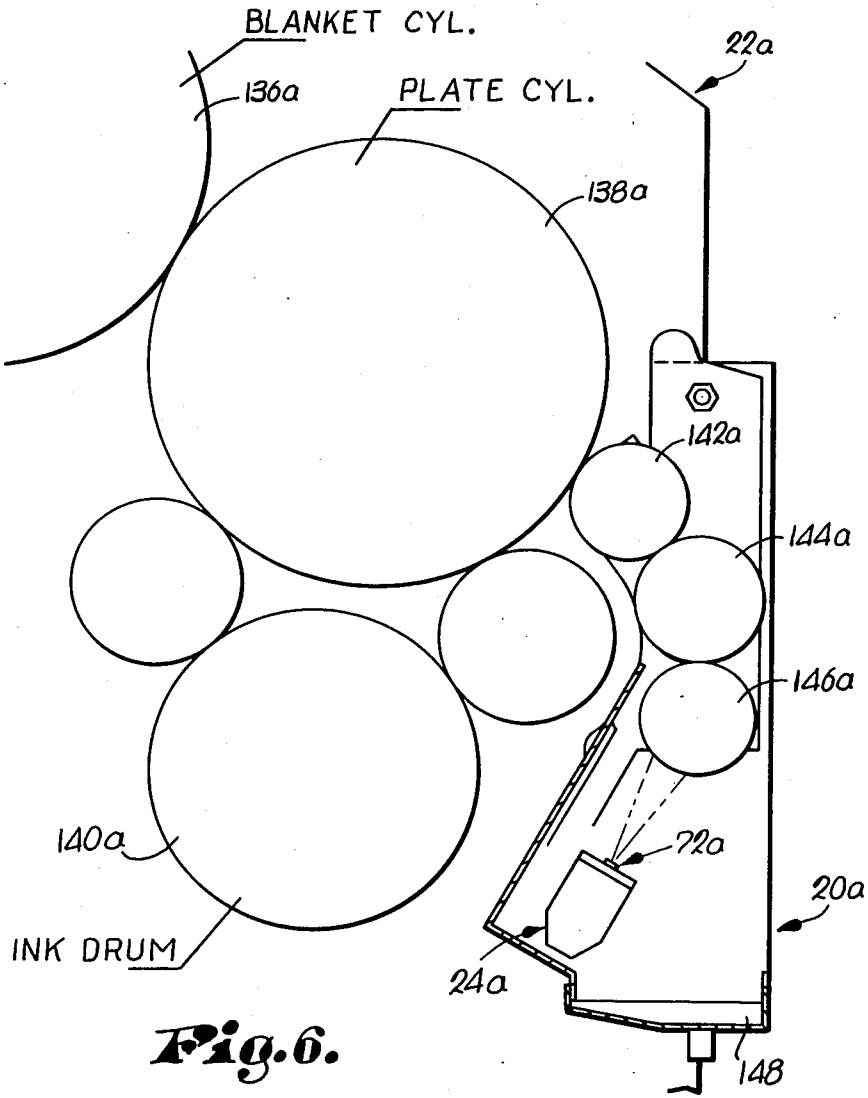
FIG. 6 is an enlarged, side elevational view in partially schematic form of the dampening system shown in FIG. 1 when the system is utilized in conjunction with another type of press.

FIGS. 6 and 7 show another use of the spray dampening system **20*a* of the present invention as installed on a press unit 22a having a blanket cylinder 136a and a plate cylinder 138a in rolling contact with the blanket cylinder 136a. As is similar to the press 22 shown in FIG. 2, the press 22a in FIGS. 6 and 7 has an ink train 140a that is separate from and spaced from the dampening system 20a**.

A first roller 142a is in surface contact with plate cylinder 138a, a second roller 144a is in rolling engagement with the first roller 142a, and a third roller 146a is in rolling contact with the second roller 144a. However, in this instance, a spray bar 24a of the dampening system 20a is positioned so that a spray of dampening fluid is directed upwardly toward the third roller 146a as shown in FIG. 6. Water pan 148a is connected to a drain to dispose of accidental leakage or excess dampening fluid when desired.

In all other respects, the rollers 142a–146a are identical to the rollers 142–146 shown in FIG. 2, both in material composition as well as the uniform, matt finish that is provided for the rubber surface. Thus, in the press 22 of FIG. 2 as well as the press 22a of FIGS. 6 and 7, dampening fluid is metered through a first nip between the first roller 142 and the second roller 144, and is also metered through a second nip between the second roller 144 and the third roller 146, and moreover the dampening fluid is metered through another nip between the first roller 142 and the plate cylinder 138 so that even, uniform distribution of dampening fluid is enhanced over the surface areas of the plate cylinder 138.

An outer edge segment 149a (FIG. 7) is advantageously provided on roller 146a with a roughened or knurled finish which is rougher in texture than the remaining major portion of roller 146a to facilitate frictional engagement for surface driving of roller 146 from plate cylinder 138a. Although not shown, roller 142a as well as rollers 142, 146 in FIG. 2 are desirably also provided with similar edge segments.

In operation of press 22, the sensor 40 (FIG. 1) detects the speed of the drive shaft 42 and transmits a signal to the control station 46, and the latter then transmits a series of electrical pulses to the coils 56 wherein the frequency of the pulses is determined by the speed of the drive shaft 42. Although the duration of each pulse is normally held constant, the potentiometer associated with the control station 46 allows independent manual adjustment of the duration of the pulses for each nozzle assembly 26, may be desired when relatively fine control of the quantity of water reaching the plate is needed. Each potentiometer is infinitely variable and is operable to change the duration of the pulse in linear relation to the angular degree of rotation of the potentiometer shaft. However, in practice, it has been found that the potentiometer is used rarely if at all, and instead the operator is encouraged to retain the rotative position of the potentiometer in a fixed orientation and generally not adjust the same unless abnormal conditions appear to be present.

FIG. 3 represents the preferred coverage of the system 20 of the instant invention as applied to newspapers commonly found in the United States, although it should be understood that such an illustration is representative only of the coverage and does not imply that the dampening fluid is sprayed directly onto a roller in engagement with paper. In FIG. 3, a spray bar 24 is shown having eight equally spaced nozzles 72 which direct the dampening fluid over a double width of newspaper 134 having a dimension typically of 55" and representing four pages.

Figure 4:
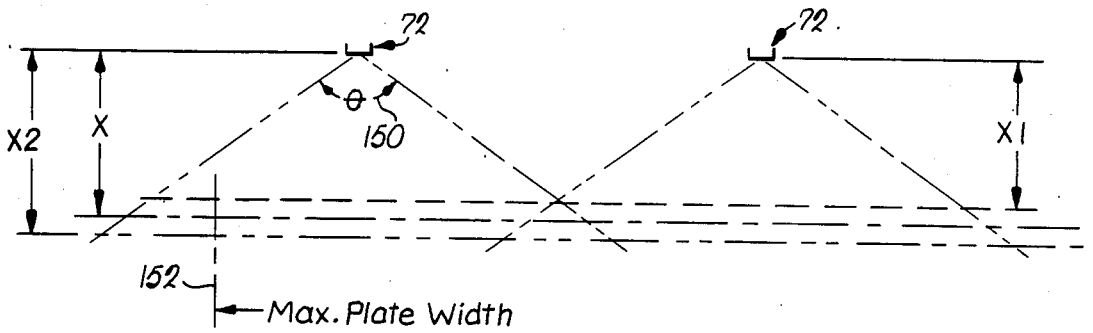
FIG. 4 is an enlarged, graphical depiction of the pattern of dampening fluid spray emanating from two of the nozzles shown in FIG. 3.
Figure 5:
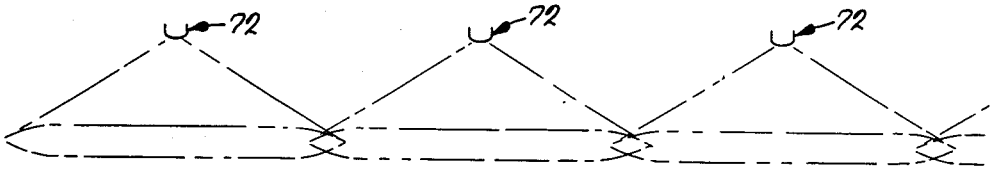
FIG. 5 is an enlarged, fragmentary depiction of the outer boundaries of the spray pattern produced from three of the nozzles illustrated in FIG. 3, particularly showing the overlap of the spray pattern from adjacent nozzles which occurs when the fluid contacts an associated roller.

Viewing FIGS. 4 and 5, a representative depiction of the pattern defined by the nozzles 72 is illustrated in broken lines, and the configuration of the spray pattern on the associated third roller 146 (not shown in FIGS. 4–5) is highly critical to the success of the present invention. The aforementioned preferred nozzle, No. 11001, sold under the tradename Unijet® by Spray Systems Company of Wheaton, Ill. provides a spray angle $\theta$ which is indicated at the numeral 150 in FIG. 4 and which is 110° at 40 psi. It is preferred that the pressure of the dampening fluid as provided by the pump 30 remain at approximately 40 psi, since smaller pressures will reduce the angle $\theta$ accordingly while larger pressures will increase the spray angle $\theta$. A pressure of 40 psi is considerably advantageous over conventional spray systems using pressures as high as 80 psi or 100 psi, since higher pressures cause system components to experience greater wear and leakage, and increase the operational costs of the press. The center-to-center distance between the center of the orifices 74 of the nozzles 72 is 4 inches to 10 inches, although better results have been observed when the center-to-center spacing is 6 to 8 inches, and best results have been observed when the center-to-center spacing is 7.1 inch.

The spray pattern that is produced on the third roller 146 is critically defined by the distance between the nozzles 72 and the third roller 146 as well as the aforementioned distance between adjacent nozzles 72. Good results have been observed when the nozzle 72 is spaced from the third roller 146 a distance in the range of 2.5 inches to 3.2 inches (represented as "X1" and "X2" respectively in FIG. 4), and best results have been observed when the nozzle 72 is spaced from the third roller 146 a distance of 2.8 inches (designated "X" in FIG. 4). Again referring to FIG. 4, when the distance designated X is 2.8 inches, and the spray angle $\theta$ is 110°, the extent of overlap between adjacent spray patterns on the third roller 146 as measured along the longitudinal axis of the latter is 1.0 inch, while the overspray caused by outermost nozzles 72 located on end portions of bar 24 terminates on the third roller 146 at a location which corresponds to 1.50 inch from the edge of the 54.875 inch wide lithographic plate mounted on plate cylinder 138, such location being indicated by the line designated 152.

Although best results are observed when the length of the overlap patterns of spray from adjacent nozzles 72 is 1.0 inch and the overspray terminates in an area corresonding to 1.50 inches away from the edge of the lithographic plate, good results have also been observed when the overlap pattern from adjacent nozzles 72 is a length in the range of approximately $\frac{1}{8}$ inch to $2\frac{1}{4}$ inches, while the end nozzles associated with edge portions of the plate cylinder 138 provide a pattern of overspray terminating in an area of the third roller 146 which corresonds to an area of the plate cylinder 138 a distance of approximately $\frac{3}{4}$ inch to approximately $2\frac{1}{4}$ inches away from the edge of the lithographic plate. However, somewhat better results than the last mentioned results are observed when the length of the overlap patterns from adjacent nozzles 72 is in the range of approximately $\frac{3}{4}$ inch to $1\frac{1}{4}$ inches, and when the pattern of overspray from end nozzles 72 on the spray bar 24 terminates in an area of the third roller 146 a distance corresonding to approximately $1\frac{1}{4}$ inches to approximately 1¾ inches away from the edge of the lithographic plate mounted on cylinder 138.

Referring to FIG. 5, the spray pattern produced from the nozzles 72 when the spray reaches the third roller 146 (not shown in FIG. 5) has an elongated configuration with tapered edge portion, and the thickness of the spray pattern along the majority of the length of the latter is typically 1.25 inch to 1.50 inch. Generally, the spray produced by the nozzles 24 is uniformly distributed in the entire area of the pattern, although the edges of the latter are somewhat indistinct. Overspray at locations corresponding to areas adjacent edges of the plate is carefully maintained so that the plate edges are properly dampened.

The tapered edge portions of each of the spray patterns shown in FIG. 5 represents a smaller quantity of dampening fluid per longitudinal inch of roller 146 from each nozzle 72 that is produced within the center regions of the spray pattern. However, since the nozzles 72 are arranged so that the spray patterns from adjacent nozzles 72 overlap, sufficient amounts of dampening fluid are provided on the third roller 146 in all regions along the length of the latter. The parameters set forth hereinabove which detail preferred center-to-center nozzle spacings as well as the spacing between the nozzles 72 and the third roller 146 enable the dampening fluid to be uniformly and evenly distributed along the length of the third roller 146 to a degree heretofore unknown, even though some overlap is present. The overlap of spray pattern is highly critical, since excess dampening fluid at these locations can otherwise cause water spotting at corresponding locations of the printed image.

An important aspect of the present invention is the elmination of stagnant areas in the dampening fluid conduit means so that the fluid is constantly in circulation for filtering and distribution to nozzles 72. The lines 34, 38, the nozzle assemblies 26 as well as the supply cabinet 28 have been constructed without stagnant or "dead" areas, and the filter 32 continuously removes contaminates during each pass of the fluid. By comparison, known prior art dampening systems utilize a screen filter associated with each spray nozzle in an attempt to avoid clogging of the nozzle orifices.

As explained earlier, it has been found that construction of the dampening system 20 in accordance with the limits defined by a first set of certain parameters greatly simplifies the operation of the press 22 to a degree heretofore unknown in the art. When the press is running at fully normal operating speed in the range of 40,000 to 55,000 newspapers per hour, and preferably 40,000 newspapers per hour, wherein the cutoff length of the newspaper is in the range of 21 inches to 23.56 inches, and preferably 22.75 inches, best results are attained, in combination with the aforementioned preferred nozzle locations, when the duration of the pulse is in a range of approximately 15 milliseconds to approximately 30 milliseconds, the pressure of the dampening fluid is approximately 40 psig, and the frequency of the pulse series lies in a range of approximately 300 pulses to approximately 350 pulses. In these limits, the ink/dampening fluid balance will be maintained at the required ratio such that operation of the dampening system 20 is thus substantially fully automatic and does not require the attention of the user.

Preferably, the volume of dampening fluid to be delivered to the plate cylinder during each rotation thereof should range from 30% to 50% on an established scale wherein 0% is confirmed by light scumming and 100% is confirmed by excessive dampening fluid in the press 22. An oversupply of dampening fluid can be observed by water retained in the nips of the rollers, a shiny reflection of water on the plate, or water standing in the ink fountain. An oversupply of dampening fluid may also be observed by excessive emulsification of the ink such that black ink becomes gray and the resultant printed image is not of high contrast.

The instant invention may also be practiced by construction of a press 22 in accordance with a second set of parameters in combination with the aforementioned nozzle locations which yield high quality printing but of somewhat lesser quality than the printing obtained by the first set described above. In the second set of parameters, and at full press speed, the duration of each pulse is in a range of approximately 20 milliseconds to approximately 40 milliseconds, and the pressure of the dampening fluid as provided by the pump 30 is in the range of approximately 30 psig to approximately 50 psig. The series of pulses has a frequency ranging from approximately 100 pulses per minute to approximately 400 pulses per minute.

A third set of parameters in combination with the abovementioned nozzle locations has also been found to provide good results, although of somewhat lesser quality than the result obtained through use of the parameters described in the first and second sets. In the third set, the duration of each pulse lies in a range from approximately 5 milliseconds to approximately 75 milliseconds, and the pump 30 provides pressure on the dampening fluid of approximately 20 psig to approximately 60 psig. The frequency of the pulse series is in a range of approximately 50 pulses per minute to approximately 600 pulses per minute at full press speed.

In the operation of a newspaper press, it has been found that only a certain amount of water or dampening fluid is necessary to keep the plate clean regardless of the amount of ink applied to the plate, perhaps due in part to the characteristics of the aluminum plate. Use of a spray dampening system 20 constructed in accordance with the parameters described herein enables the press 22 to be operated substantially automatically without manual control of the dampening system 20, such that labor costs as well as maintenance costs are correspondingly reduced. At the same time, the uniform, fine spray provided by practice of the instant invention provides a printed image of substantially high quality, due not only to the nature of the surface driven rollers 142, 144 and 146 and the nips therebetween, but also due to the abovementioned critical parameters, and particularly the nozzle center-to-center spacings and nozzle-to-roller spacings, and the duration and frequency of each pulse of sprayed dampening fluid. Additionally, by providing a dampening system which is separate from and not associated with any components of the ink train, excessive intermixing of the dampening fluid in the ink is substantially precluded.

Importantly, use of the parameters as disclosed herein enables the spray bar 24 to be mounted within the aisle 25 of adjacent press units 22, enabling easy access to the spray bars 24 as may be necessary. Moreover, the detachable means mounting the spray bars 24 to the press frame 84 allows any of the bars 24 to be selectively removed from the press unit 22 during operation of the latter, so that elaborate shutdown procedures can be avoided. Finally, by supplying a fresh, constantly circulating supply of dampening fluid to each of the nozzles 72, plugging of the latter is avoided to ensure that the third roller 146 inevitably receives a uniform, fine distribution of dampening fluid along the length of the latter for subsequent transfer to the plate cylinder 138.

I claim:

1. In a lithographic press having a rotatable cylinder, a lithographic plate mounted on said cylinder and having at least one ink receptive area, and means for providing ink to said at least one ink respective area of said plate, a dampening system for delivering ink-repellant dampening fluid to said plate comprising:

a first roller in rolling engagement with said plate and having a flexible surface with a Shore A durometer hardness of 25 to 40;

a second roller in rolling contact with said first roller and having an outer surface selected from the group consisting of chromium, nickel and ebonite;

a third roller in rolling engagement with said second roller and having a flexible surface with a Shore A durometer hardness of 25 to 40;

said first roller and said second roller presenting a first nip therebetween and said second roller and said third roller presenting a second nip therebetween, said first roller, said second roller and said third roller being spaced from said means for providing ink to said plate for generally precluding the entry of substantial quantities of ink into said dampening system, each of said surfaces of said first, second and third rollers causing respective rollers to be driven at essentially the same speed of rollers in contact with each of said surfaces;

a supply of dampening fluid pressurized to approximately 30 psi to approximately 60 psi;

conduit means coupled with siad fluid supply;

a plurality of nozzles coupled with said conduit means for spraying dampening fluid toward said third roller;

valve means associated with said conduit means and operable to interrupt the flow of dampening fluid through said conduit means; and control means connected to said valve means for selective operation of the latter, said control means being operable to enable flow of said fluid from said conduit through said nozzles during a pulse of time having a duration ranging from approximately 5 milliseconds to approximately 75 milliseconds, said control means being operable to provide a series of said pulses having a frequency ranging from approximately 50 pulses per minute to approximately 600 pulses per minute at full press speed, said nozzles being spaced apart from each other a distance in the range of approximately 4 inches to 10 inches, said nozzles being spaced from said third roller a distance in the range of approximately 2 inches to approximately 4 inches, said spacing of said nozzles relative to each other and said spacing of said nozzles relative to said third roller being such that the pattern of spray on said third roller provided by each nozzle overlaps the pattern of spray on said third roller provided by adjacent nozzles for substantially uniform distribution of said dampening fluid to said third roller along essentially the entire length of said third roller and to provide even transfer of said dampening fluid from said third roller to said second and first rollers and thereby to said plate as said dampening fluid is metered through said first nip between said first and second roller and through said second nip between said second and third roller.

2. The invention of claim 1, wherein said conduit means including first piping means for delivering dampening fluid from said fluid supply to said nozzles and second piping means for returning a portion of said dampening fluid in said first piping means to said fluid supply when said valve means interrupts the flow of fluid through said nozzle, and said conduit means includes filtering means for removing impurities from said fluid as the latter is circulated through said first and second piping means.

3. The invention of claim 1, wherein said overlap patterns from adjacent nozzles has a length parallel to the longitudinal axis of said third roller in the range of approximately $\frac{1}{8}$ inch to approximately $2\frac{1}{4}$ inches, and said plurality of nozzles includes nozzles associated with edge portions of said cylinder which provide a pattern of overspray terminating in an area of said third roller which corresponds to an area of said cylinder a distance of approximately $\frac{3}{4}$ inch to approximately $2\frac{1}{4}$ inches from the edge of said lithographic plate.

4. The invention of claim 3, wherein said length of overlap patterns from adjacent nozzles is in the range of approximately $\frac{3}{4}$ inch to approximately $1\frac{1}{4}$ inches, and wherein said pattern of overspray terminates in an area of said third roller a distance corresponding to approximately $1\frac{1}{4}$ inches to approximately $1\frac{3}{4}$ inches away from the edge of said plate.

5. The invention of claim 4, wherein said length of overlap of spray patterns from adjacent nozzles is approximately 1 inch, and said pattern of overspray terminates in an area of said third roller a distance corresponding to $1\frac{1}{2}$ inches away from the edge of said plate.

6. The invention of claim 3, wherein said dampening fluid is pressurized to a valve within the range of approximately 35 psi to approximately 45 psi.

7. The invention of claim 6, wherein said dampening fluid is pressurized to a value of approximately 40 psi.

8. The invention of claim 3, wherein said nozzles are spaced from said third roller a distance in the range of approximately 2.5 inches to approximately 3.2 inches.

9. The invention of claim 8, wherein said nozzles are spaced from said third roller a distance of approximately 2.8 inches.

10. The invention of claim 1, wherein said control means is operable to vary the frequency of said pulses in accordance with the speed of the press, and said control means includes manually adjustable means for varying the duration of said pulses during operation of the press in response to the observed quality of printing resulting from the quantity of dampening fluid delivered to said plate.

11. The invention of claim 1, wherein the first second and third rollers are rotated by the surface contact of the first roller with the plate, the second roller with the first roller and the third roller with the second roller.

12. The invention of claim 11, wherein the first roller is adapted to contact the plate, the second roller engages the first roller and the third roller engages the second roller with sufficient frictional engagement to cause the rollers to be driven at a surface speed which is equal to that of the plate cylinder.

13. A method of supplying dampening fluid to a rotatable lithographic plate cylinder of an offset press comprising:

contacting a first roller having a surface Shore A durometer hardness of 25 to 40 in rolling engagement with said plate cylinder;

engaging a second roller having an outer surface selected from the group of chromium, nickel and ebonite in rolling contact with said first roller;

contacting a third roller having a surface Shore A durometer hardness of 25 to 40 in rolling engagement with said second roller;

pressurizing a quantity of dampening fluid to a value within the range of approximately 30 psi to approximately 60 psi;

providing a plurality of nozzles spaced apart from each other a distance in the range of approximately 4 inches to approximately 10 inches and spaced from said third roller a distance in the range of approximately 2 inches to approximately 4 inches; and directing said dampening fluid through said nozzles and toward said third roller during pulsed intervals of time having a duration ranging from approximately 5 milliseconds to approximately 75 milliseconds and a frequency ranging from approximately 50 pulses per minute to approximately 600 pulses per minute at full press speed, said step of providing said nozzles at spaced apart distances and at a spaced distance from said third roller being such that said step of directing said dampening fluid through said nozzles provides substantially uniform distribution of dampening fluid to said third roller along essentially the entire length of the same for subsequent even transfer of said dampening fluid to said second roller, said first roller and thereby to said plate.

14. The method as set forth in claim 13, wherein said step of directing dampening fluid through said nozzles includes the step of overlapping patterns of spray on said third roller from adjacent nozzles a distance in the range of approximately 150 inch to approximately 2¼ inches.

15. The method as set forth in claim 14, wherein said step of directing dampening fluid through said nozzles includes the step of overlapping patterns of spray on said third roller from adjacent nozzles a distance in the range of approximately ¾ inch to approximately 1¼ inches.

16. A spray bar assembly for a dampening system of a lithographic press comprising:

an elongated support;

a plurality of spray nozzles mounted in spaced relationship to each other along the length of said support;

first conduit means carried by said support and connected to said nozzles for supplying a quantity of dampening fluid to the latter, said conduit means including a first coupling body;

electrically actuated valve means associated with said first conduit means and operable to interrupt the flow of dampening fluid through said first conduit means to said nozzles;

first lead means carried by said support and electrically coupled to said valve means for enabling current to actuate said valve means, said first lead means including a first contact element;

a press frame;

second conduit means mounted to said press frame and including a second coupling body complemental with said first coupling body of said first conduit means;

second lead means mounted to said press frame and including a second contact element electrically engageable with said first contact element of said first lead means; and means detachably mounting said support on said frame, said first coupling body and said first contact element being positioned on said support for complemental engagement with said second coupling body and said second contact element respectively when said support is mounted on said frame by said mounting means of enabling the flow of dampening fluid from said second conduit means to said first conduit means and for enabling the flow of electrical current from said second lead means to said first lead means, said first coupling body and said first contact element being positioned on said support for disengagement with said second coupling body and said second contact element respectively when said mounting means detaches said support from said frame such that the flow of dampening fluid through said first conduit means and the flow of electrical current through said first lead means is thereby interrupted.

17. The invention of claim 16, wherein said support includes a first end portion and a second end portion remote from said first end portion, said first coupling body and said first contact element are mounted on said first end portion, and said mounting means includes a member detachably interconnecting said second end portion of said support and said frame, said member being shiftable to selectively move said first coupling body and said first contact element selectively either toward or away from said second coupling body and said second contact element respectively.

18. The invention of claim 17, wherein said member is threadably connected to said frame for shifting said support in either direction along the longitudinal axis of the latter.

19. The invention of claim 16, wherein said mounting means includes a flange connected to one of said support and said frame and said mounting means also includes a shoulder connected to the other of said support and said frame, said flange and said shoulder being slidably engageable with each other as said support is mounted on said frame for enabling said frame to carry at least a portion of the weight of said support and to position said first coupling body and said first contact element in a predetermined orientation relative to said second coupling body and said second contact element.

20. The invention of claim 16, wherein said second coupling body includes a valve device, and said first coupling body includes a fitting detachably engageable with said valve device when said first coupling body is moved to engage said second coupling body, said device being shiftable by said fitting to enable the flow of fluid through said second conduit means when said first coupling body is moved to engage said second coupling body, said device being yieldably biased toward a closed position to interrupt the flow of fluid through said second conduit means when said fitting is detached from said valve device as said first coupling body is moved to disengage said second coupling body.

21. In a lithographic press having a rotatable cylinder, a lithographic plate mounted on said cylinder and having at least one ink receptive area, and means for providing ink to said at least one ink respective area of said plate, a dampening system for delivering ink-repellant dampening fluid to said plate comprising:

a first roller in rolling engagement with said plate and having a rubber outer surface;

a second roller in rolling contact with said first roller and having an outer surface selected from the group consisting of chromium, nickel and ebonite;

a third roller in rolling engagement with said second roller and having a rubber outer surface;

said first roller and said second roller presenting a first nip therebetween and said second roller and said third roller presenting a second nip therebetween, said first roller, said second roller and said third roller being spaced from said means for providing ink to said plate for generally precluding the entry of substantial quantities of ink into said dampening system, a supply of dampening fluid pressurized to approximately 30 psi to approximately 60 psi;

conduit means coupled with said fluid supply;

a plurality fo nozzles coupled with said conduit means for spraying dampening fluid toward said third roller;

valve means associated with said conduit means and operable to interrupt the flow of dampening fluid through said conduit means; and control means connected to said valve means for selective operation of the latter, said control means being operable to enable flow of said fluid from said conduit through said nozzles during a pulse of time having a duration ranging from approximately 5 milliseconds to approximately 75 milliseconds, said control means being operable to provide a series of said pulses having a frequency ranging from approximately 50 pulses per minute to approximately 600 pulses per minute at full press speed, said nozzles being spaced apart from each other a distance in the range of approximately 4 inches to 10 inches, said nozzle being spaced from said third roller a distance to cause direct impingement of dampening fluid on the third roller from respective nozzles, said spacing of said nozzles relative to each other and said spacing of said nozzles relative to said third roller being such that the pattern of spray on said third roller provided by each nozzle overlaps the pattern of spray on said third roller provided by adjacent nozzles for substantially uniform distribution of said dampening fluid to said third roller along essentially the entire length of said third roller and to provide even transfer of said dampening fluid from said third roller to said second and first rollers and thereby to said plate as said dampening fluid is metered through said first nip between said first and second roller and through said second nip between said second and third roller.

* * * * *